US011634200B2

(12) United States Patent
Wood et al.

(10) Patent No.: US 11,634,200 B2
(45) Date of Patent: Apr. 25, 2023

(54) WATERCRAFT PADDLE ASSEMBLY

(71) Applicants: Clint Wood, Chaska, MN (US); Brent Hays, Vermillion, SD (US); Joshua Sampson, Yankton, SD (US)

(72) Inventors: Clint Wood, Chaska, MN (US); Brent Hays, Vermillion, SD (US); Joshua Sampson, Yankton, SD (US)

( * ) Notice: Subject to any disclaimer, the term of this patent is extended or adjusted under 35 U.S.C. 154(b) by 68 days.

(21) Appl. No.: 17/345,138

(22) Filed: Jun. 11, 2021

(65) Prior Publication Data

US 2022/0396342 A1 Dec. 15, 2022

(51) Int. Cl.
*B63H 16/04* (2006.01)

(52) U.S. Cl.
CPC ..... *B63H 16/04* (2013.01)

(58) Field of Classification Search
CPC ..... B63H 16/04; B63H 2016/043; B63H 2016/046; B63H 16/00
See application file for complete search history.

(56) References Cited

U.S. PATENT DOCUMENTS

| | | | | |
|---|---|---|---|---|
| 1,107,169 | A * | 8/1914 | Kerns | B63H 16/04 416/74 |
| 4,673,361 | A | 1/1987 | Harvey | |
| 5,851,132 | A | 12/1998 | Merrill | |
| 6,328,617 | B1 | 12/2001 | Gunnell | |
| 6,514,109 | B1 | 2/2003 | Carlow | |
| 6,702,727 | B2 | 3/2004 | Karsten | |

* cited by examiner

*Primary Examiner* — Jacob M Amick

(57) ABSTRACT

A watercraft paddle assembly for enhancing comfort while paddling a watercraft includes a paddle that has a handle portion is elongated and a paddle portion. A roller attachment is coupled to the handle portion and the roller attachment is distally positioned with respect to paddle portion of the paddle. The roller attachment has an attached section that is oriented at an angle with a roller section. A roller is rotatably integrated into the roller section of the roller attachment such that the roller can be gripped by the user. The roller is oriented to rotate about an axis that is oriented perpendicular to a lengthwise axis of the paddle to facilitate the user to grip the roller and the handle portion of the paddle in a preferred manner for paddling.

9 Claims, 5 Drawing Sheets

WATERCRAFT PADDLE ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to paddle devices and more particularly pertains to a new paddle device for enhancing comfort while paddling a watercraft. The device includes a paddle and a roller attachment that is coupled to the paddle. The roller attachment has a roller section that is oriented perpendicular to a lengthwise axis of the paddle. A roller is rotatably positioned around the roller section which is gripped by a user during paddling.

(2) Description of Related Art Including Information Disclosed Under 37 CFR 1.97 and 1.98

The prior art relates to paddle devices including a kayak paddle with a crossbar structure incorporated into the kayak paddle for improving gripping the kayak paddle. The prior art discloses a kayak paddle which includes a pair of rollers that is each integrated into a handle section of the paddle and are positioned between pairs of paddle sections of the paddle. The prior art discloses a kayak paddle that has strategically positioned bends for enhancing efficiency of the kayak paddle. The prior art discloses a kayak paddle that includes a pair of rollers that are rotatably integrated into the kayak paddle and which are rotatable about a lengthwise axis of the kayak paddle. The prior art discloses a paint roller that includes a roller attachment and a roller that is rotatably integrated into the roller attachment.

BRIEF SUMMARY OF THE INVENTION

An embodiment of the disclosure meets the needs presented above by generally comprising a paddle that has a handle portion is elongated and a paddle portion. A roller attachment is coupled to the handle portion and the roller attachment is distally positioned with respect to paddle portion of the paddle. The roller attachment has an attached section that is oriented at an angle with a roller section. A roller is rotatably integrated into the roller section of the roller attachment such that the roller can be gripped by the user. The roller is oriented to rotate about an axis that is oriented perpendicular to a lengthwise axis of the paddle to facilitate the user to grip the roller and the handle portion of the paddle in a preferred manner for paddling.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
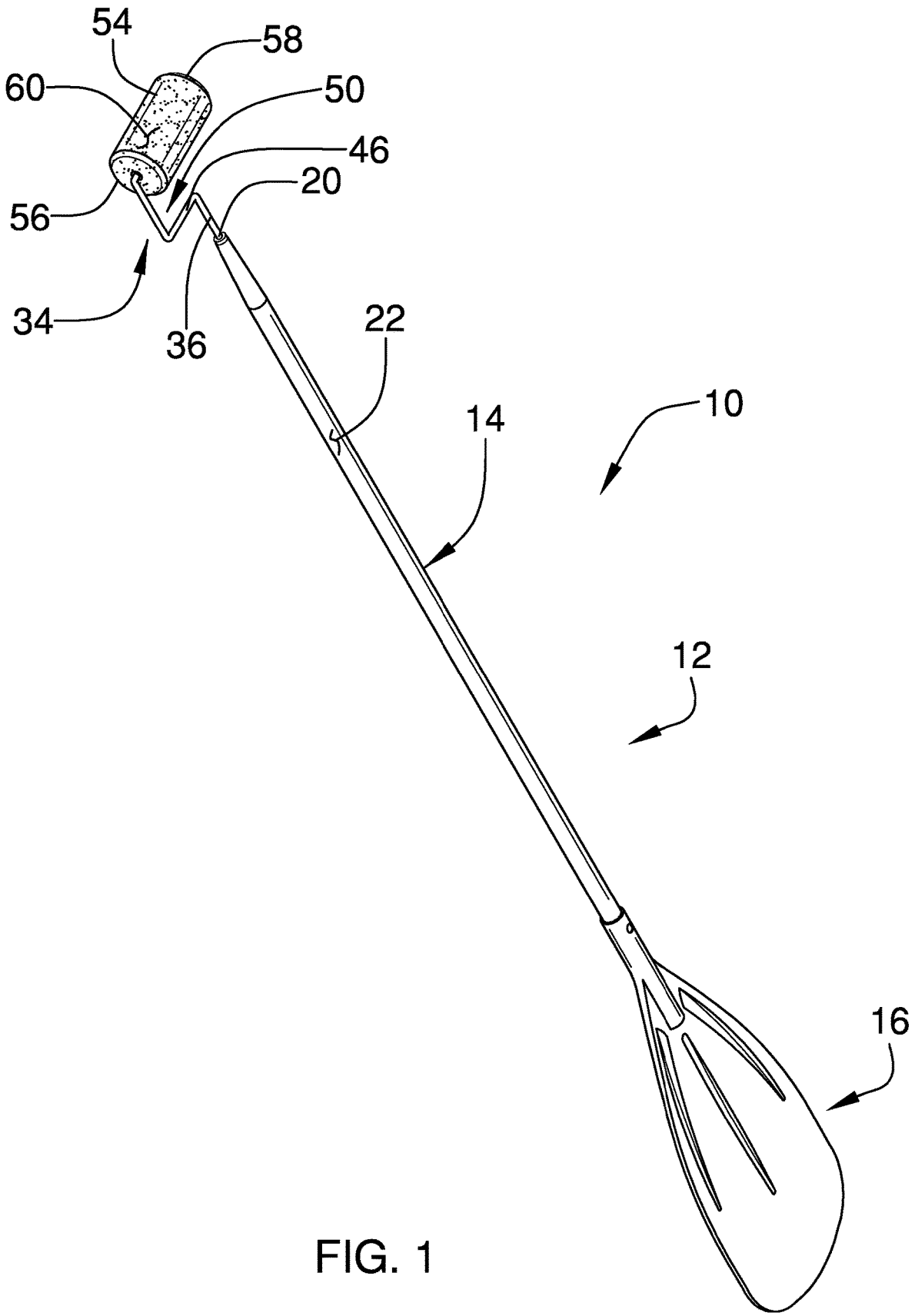
FIG. 1 is a perspective view of a watercraft paddle assembly according to an embodiment of the disclosure.
Figure 2:
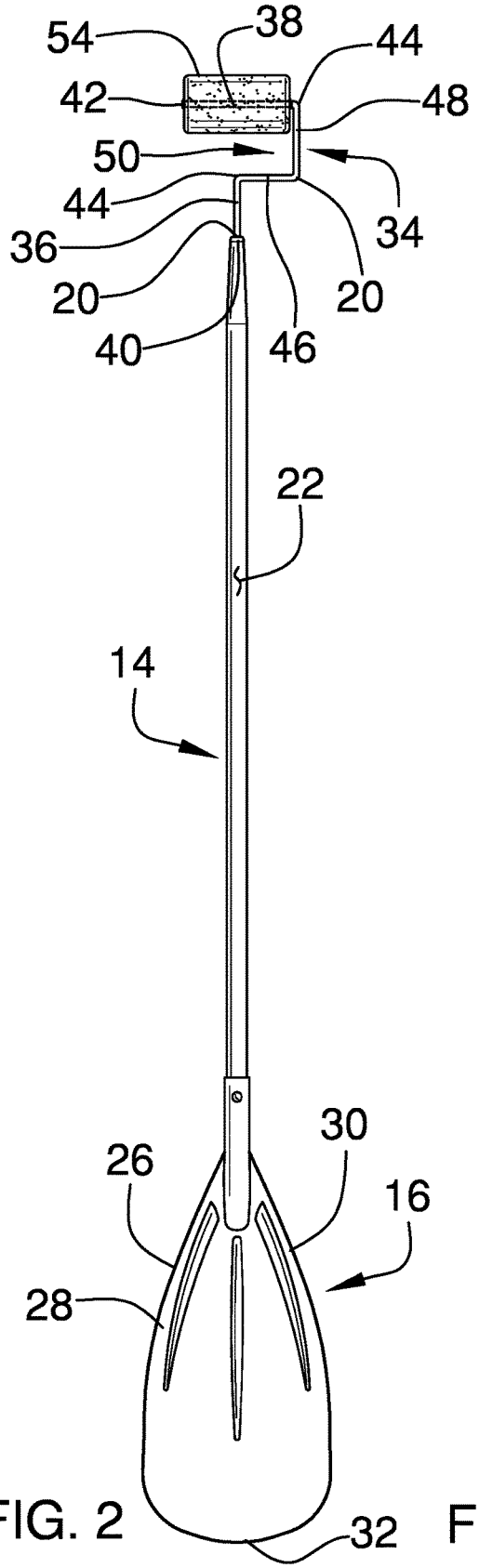
FIG. 2 is a front phantom view of an embodiment of the disclosure.
Figure 3:
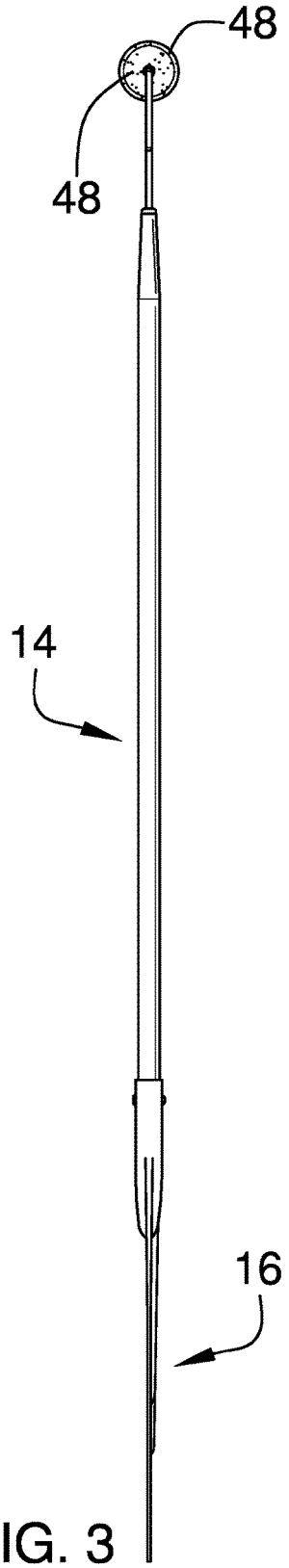
FIG. 3 is a right side view of an embodiment of the disclosure.
Figure 4:
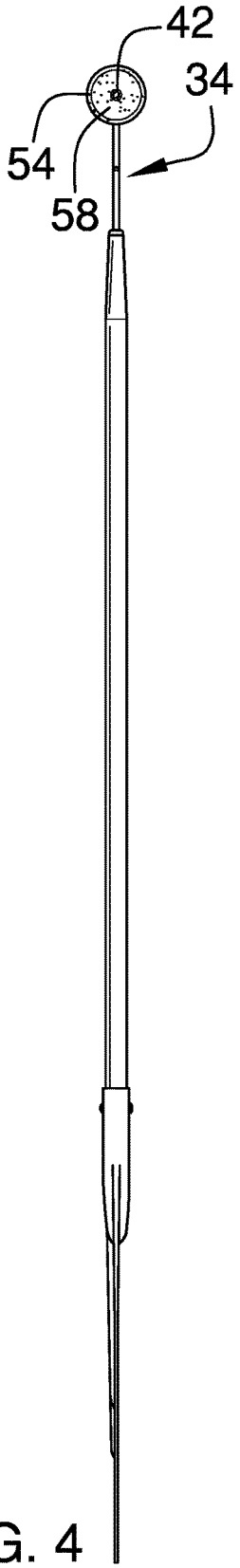
FIG. 4 is a left view of an embodiment of the disclosure.
Figure 5:
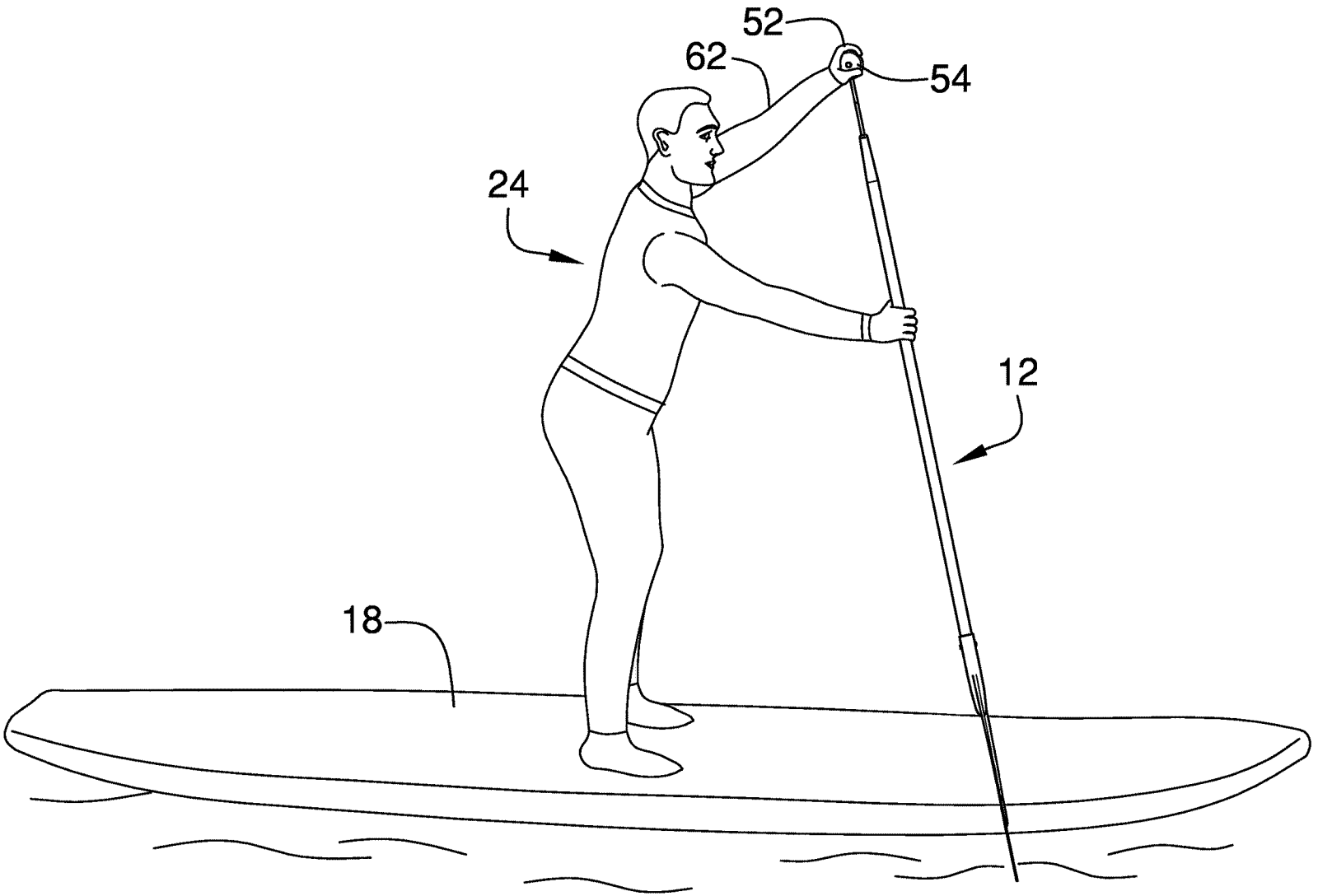
FIG. 5 is a perspective in-use view of an embodiment of the disclosure.

With reference now to the drawings, and in particular to FIGS. 1 through 7 thereof, a new paddle device embodying the principles and concepts of an embodiment of the disclosure and generally designated by the reference numeral 10 will be described.

As best illustrated in FIGS. 1 through 7, the watercraft paddle assembly 10 generally comprises a paddle 12 that has a handle portion 14 which is elongated and a paddle portion 16 which is flattened. The paddle portion 16 can be lowered into water for paddling a watercraft 18. The watercraft 18 may be a kayak, a canoe, a paddleboard or any other type of watercraft. Additionally, the paddle 12 may be structured in the convention of kayak paddles, canoe paddles or any other conventional watercraft paddle. The handle portion 14 has a distal end 20 with respect to the paddle portion 16 and the handle portion 14 has an outer surface 22 that is continuously arcuate about an axis extending between the distal end 20 and the paddle portion 16 such that the handle portion 14 has a tubular shape to facilitate a user 24 to grip the handle portion 14. The paddle portion 16 has an outer edge 26, and the outer edge 26 has a first lateral side 28, a second lateral side 30 and a bottom side 32 extending between the first lateral side 28 and the second lateral side 30. Each of the first lateral side 28 and the second lateral side 30 flares outwardly between the handle portion 14 and the bottom side 32 such that the paddle portion 16 has a tear drop shape.

A roller attachment 34 is provided and the roller attachment 34 is coupled to the handle portion 14. The roller attachment 34 is distally positioned with respect to paddle portion 16 of the paddle 12. Additionally, the roller attachment 34 has an attached section 36 that is oriented at an angle with a roller section 38 and the roller section 38 is spaced from the attached section 36. The attached section 36 is attached to the handle portion 14 having the roller section 38 being spaced from the handle portion 14 of the paddle 12. The roller attachment 34 has a first end 40 and a second end 42, the first end 40 is associated with the attached section 36 and the second end 42 is associated with the roller section 38. The first end 40 is coupled to the distal end 20 of the handle portion 14 of the paddle 12. Moreover, the attached section 36 is oriented to extend along the axis extending between the distal end 20 of the handle portion 14 and the paddle portion 16.

The roller attachment 34 has a series of bends 44 each being positioned between the first end 40 and the second end 42. The series of bends 44 defines a first section 46 that is oriented perpendicular to the attached section 36 having the first section 46 extending laterally away from the attached section 36. Additionally, the series of bends 44 defines a second section 48 that is oriented perpendicular to the first section 46 having the second section 48 extending along an axis that is oriented parallel to the axis extending through the distal end 20 of the handle portion 14 and the paddle portion 16 of the paddle 12. The bends 44 define the roller section 38 being oriented perpendicular to the second section 48. Moreover, the roller section 38 extends along an axis that is oriented perpendicular to the axis extending through the distal end 20 of the handle portion 14 and the paddle portion 16 of the paddle 12. Additionally, the roller section 38 is spaced from the first section 46 to define a hand space 50 between the roller section 38 and the first section 46 to accommodate the user's hand 52.

A roller 54 is provided and the roller 54 is rotatably integrated into the roller section 38 of the roller attachment 34 such that the roller 54 can be gripped by the user 24. The roller 54 is oriented to rotate about an axis that is oriented perpendicular to a lengthwise axis of the paddle 12. In this way the roller 54 facilitates the user 24 to grip the roller 54 and the handle portion 14 of the paddle 12 in a preferred manner for paddling. Thus, a user 24 that is standing on a paddleboard, for example, can more comfortably paddle the paddleboard as compared to a traditional paddle that has fixed gripping points.

The roller 54 has a primary end 56, a secondary end 58 and an outside surface 60 extending between the primary end 56 and the secondary end 58. The roller section 38 extends through the primary end 56 toward the secondary end 58 such that the roller 54 rotates about the roller section 38. In this way the roller 54 is configured to facilitate the user's forearm 62 associated with the hand 52 that is gripping the roller 54 to be oriented at a variety of angles with respect to the handle portion 14 while the user 24 is paddling. The roller 54 may be comprised of a resiliently compressible material to enhance comfort for the user 24, sand the outside surface 60 of the roller 54 may be textured to enhance gripping the roller 54. Additionally, the roller 54 may include friction reducing bearings that each engage the roller section 38 of the roller attachment 34 to enhance rotation of the roller 54.

Figure 6:
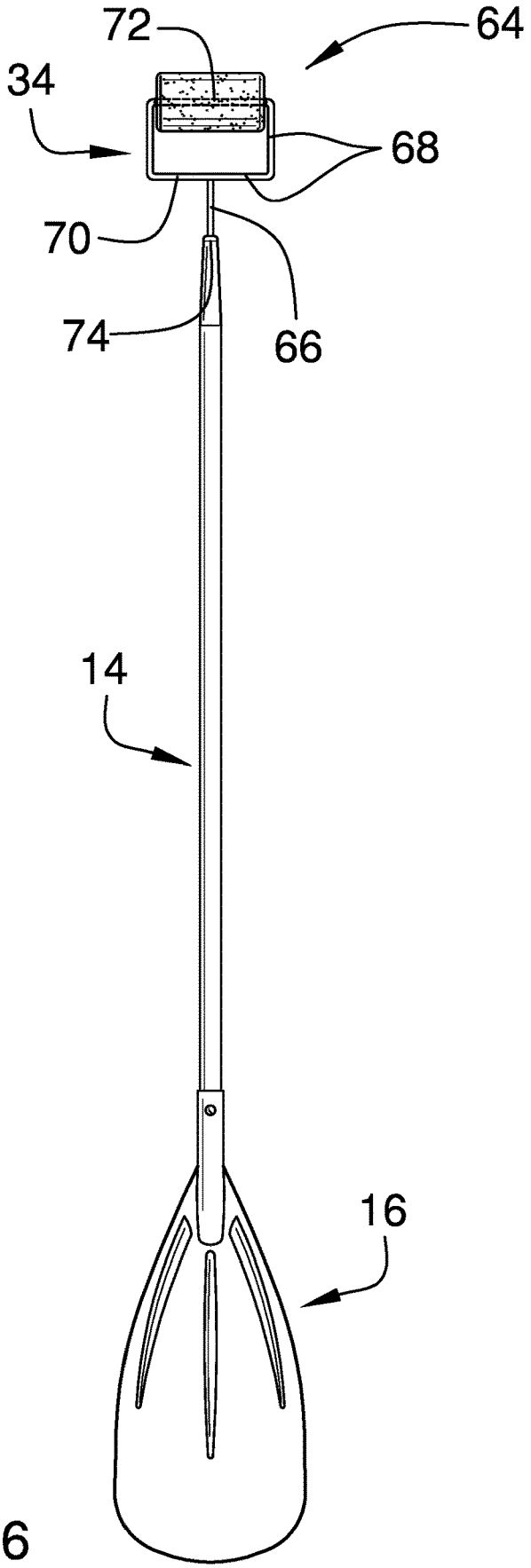
FIG. 6 is a perspective view of an alternative embodiment of the disclosure.

In an alternative embodiment 64 as is most clearly shown in FIG. 6, the roller attachment 34 may include a stem 66 and a plurality of members 68 that are oriented at right angles with each other such that the plurality of members 68 defines a rectangle. The plurality of members 68 may include a lower member 70 and an upper member 72. The stem 66 may be oriented perpendicular to the lower member 70 and the stem 66 may be centrally positioned on the lower member 70. A distal end 74 of the stem 66 may be coupled to the distal end 20 of the handle portion 14 of the paddle 12 having the rectangle defined by the members 68 being spaced from the handle portion 14. Additionally, the roller 54 may be rotatably positioned around the upper member 72.

Figure 7:
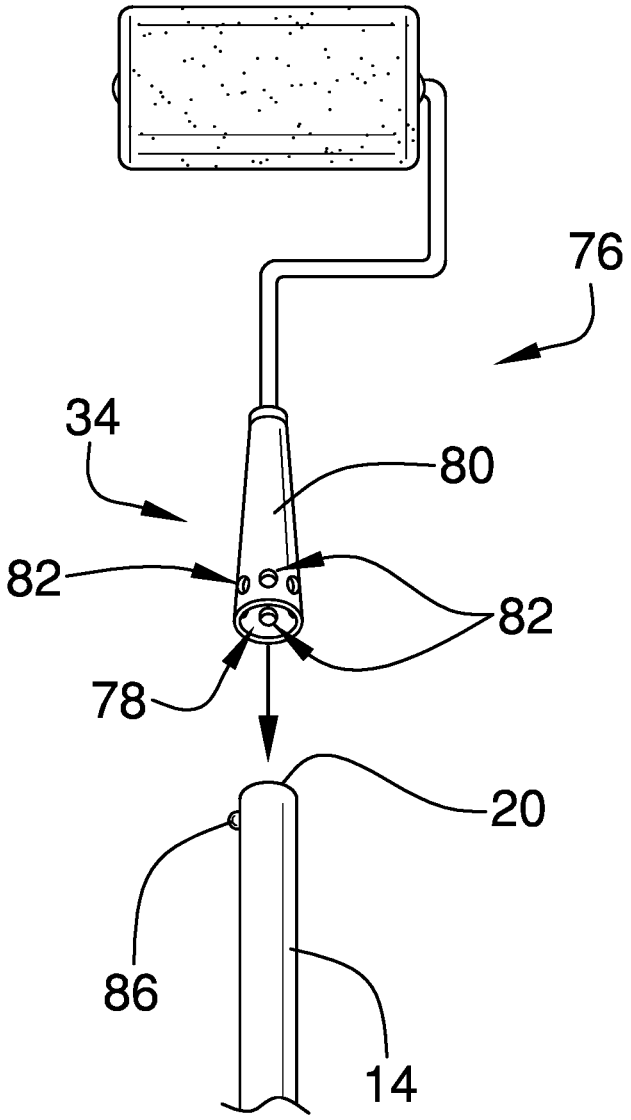
FIG. 7 is a front view of an alternative embodiment of the disclosure.

In an alternative embodiment 76 as is most clearly shown in FIG. 7, the roller attachment 34 comprises a socket 78 for slidably receiving the distal end 20 of the handle portion 14 of the paddle 12 such that the roller attachment 34 is removably attachable to the handle portion 14. The socket 78 has an outer wall 80 and the outer wall 80 has a plurality of apertures 82 each extending through the outer wall 80. Furthermore, the apertures 82 are spaced apart from each other and are distributed around a full circumference of the outer wall 80.

Continuing in the alternative embodiment 76 as is most clearly shown in FIG. 7, a lock 86 is movably integrated into the handle portion 14 of the paddle 12 and the lock 86 is positioned adjacent to the distal end 20 of the handle portion 14. The lock 86 is biased to extend outwardly from the handle portion 14 and the lock 86 is urgeable inwardly on the handle portion 14. The lock 86 engages a respective one of the apertures 82 in the outer wall 80 of the socket 78 thereby facilitating the roller 54 to be oriented at a variety of angles with respect to the paddle portion 16 of the paddle 12.

In use, the user 24 grips the handle portion 14 of the paddle 12 and the roller 54 when the user 24 wishes to employ the paddle 12 for paddling the watercraft 18. In this way the user 24 can maintain a firm grip on the paddle 12 while allowing the user's hand 52 that is gripping the roller 54 to rotate about rotational axis of the roller 54. Thus, the user 24 can paddle 12 the watercraft 18 without having to continually bend their wrist that is associated with the hand 52 that is gripping the roller 54 as is required with paddles that have fixed gripping points. Moreover, the user 24 is less likely to develop joint discomfort or pain that could result from paddling for extended periods of time with a traditional paddle.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A watercraft paddle assembly having a rollable grip for enhancing comfort to a user, said assembly comprising:

a paddle having a handle portion being elongated and a paddle portion being flattened wherein said paddle portion is configured to be lowered into water for paddling a watercraft;

a roller attachment being coupled to said handle portion, said roller attachment being distally positioned with respect to paddle portion of said paddle, said roller attachment having an attached section being oriented at an angle with a roller section, said roller section being spaced from said attached section, said attached section being attached to said handle portion having said roller section being spaced from said handle portion of said paddle;

a roller being rotatably integrated into said roller section of said roller attachment wherein said roller is configured to be gripped by the user, said roller being oriented to rotate about an axis being oriented perpendicular to a lengthwise axis of said paddle wherein said roller is configured to facilitate the user to grip said roller and said handle portion of said paddle in a preferred manner for paddling; and wherein said roller attachment includes a stem and a plurality of members being oriented at right angles with each other such that said plurality of members defines a rectangle, said plurality of members including a lower member and an upper member, said stem being oriented perpendicular to said lower member, said stem being centrally positioned on said lower member, a distal end of said stem being coupled to said distal end of said handle portion of said paddle having said rectangle defined by said members being spaced from said handle portion, said roller being rotatably positioned around said upper member.

2. The assembly according to claim 1, wherein said handle portion has a distal end with respect to said paddle portion, said handle portion having an outer surface being continuously arcuate about an axis extending between said distal end and said paddle portion such that said handle portion having a tubular shape wherein said handle portion is configured to facilitate the user to grip said handle portion, said paddle portion having an outer edge, said outer edge having a first lateral side, a second lateral side and a bottom side extending between said first lateral side and said second lateral side, each of said first lateral side and said second lateral side flaring outwardly between said handle portion and said bottom side such that said paddle portion has a tear drop shape.

3. The assembly according to claim 1, wherein:

said handle portion has a distal end with respect to said paddle portion, said paddle being elongated about an axis extending between said distal end and said paddle portion; and said roller attachment has a first end and a second end, said first end being associated with said attached section, said second end being associated with said roller section, said first end being coupled to a distal end of said handle portion of said paddle having said attached section being oriented to extend along said axis extending between said distal end of said handle portion and said paddle portion.

4. The assembly according to claim 3, wherein said roller attachment has a series of bends each being positioned between said first end and said second end, said series of bends defining a first section being oriented perpendicular to said attached section having said first section extending laterally away from said attached section, said series of bends defining a second section being oriented perpendicular to said first section having said second section extending along an axis being oriented parallel to said axis extending through said distal end of said handle portion and said paddle portion of said paddle.

5. The assembly according to claim 4, wherein said bends defines said roller section being oriented perpendicular to said second section having said roller section extending along an axis being oriented perpendicular to said axis extending through said distal end of said handle portion and said paddle portion of said paddle, said roller section being spaced from said first section to define a hand space between said roller section and said first section wherein said hand space is configured to accommodate the user's hand.

6. The assembly according to claim 1, wherein said roller has a primary end, a secondary end and an outside surface extending between said primary end and said secondary end, said roller section extending through said primary end toward said secondary end such that said roller rotates about said roller section wherein said roller is configured to facilitate the user's forearm associated with the hand that is gripping said roller to be oriented at a variety of angles with respect to said handle portion while the user is paddling.

7. A watercraft paddle assembly having a rollable grip for enhancing comfort to a user, said assembly comprising:

a paddle having a handle portion being elongated and a paddle portion being flattened wherein said paddle portion is configured to be lowered into water for paddling a watercraft, said handle portion having a distal end with respect to said paddle portion, said handle portion having an outer surface being continuously arcuate about an axis extending between said distal end and said paddle portion such that said handle portion having a tubular shape wherein said handle portion is configured to facilitate the user to grip said handle portion, said paddle portion having an outer edge, said outer edge having a first lateral side, a second lateral side and a bottom side extending between said first lateral side and said second lateral side, each of said first lateral side and said second lateral side flaring outwardly between said handle portion and said bottom side such that said paddle portion has a tear drop shape;

a roller attachment being coupled to said handle portion, said roller attachment being distally positioned with respect to paddle portion of said paddle, said roller attachment having an attached section being oriented at an angle with a roller section, said roller section being spaced from said attached section, said attached section being attached to said handle portion having said roller section being spaced from said handle portion of said paddle, said roller attachment having a first end and a second end, said first end being associated with said attached section, said second end being associated with said roller section, said first end being coupled to said distal end of said handle portion of said paddle having said attached section being oriented to extend along said axis extending between said distal end of said handle portion and said paddle portion, said roller attachment having a series of bends each being positioned between said first end and said second end, said series of bends defining a first section being oriented perpendicular to said attached section having said first section extending laterally away from said attached section, said series of bends defining a second section being oriented perpendicular to said first section having said second section extending along an axis being oriented parallel to said axis extending through said distal end of said handle portion and said paddle portion of said paddle, said bends defining said roller section being oriented perpendicular to said second section having said roller section extending along an axis being oriented perpendicular to said axis extending through said distal end of said handle portion and said paddle portion of said paddle, said roller section being spaced from said first section to define a hand space between said roller section and said first section wherein said hand space is configured to accommodate the user's hand;

a roller being rotatably integrated into said roller section of said roller attachment wherein said roller is configured to be gripped by the user, said roller being oriented to rotate about an axis being oriented perpendicular to a lengthwise axis of said paddle wherein said roller is configured to facilitate the user to grip said roller and said handle portion of said paddle in a preferred manner for paddling, said roller having a primary end, a secondary end and an outside surface extending, between said primary end and said secondary end, said roller section extending through said primary end toward said secondary end such that said roller rotates about said roller section wherein said roller is configured to facilitate the user's forearm associated with the hand that is gripping said roller to be oriented at a variety of angles with respect to said handle portion while the user is paddling; and wherein said roller attachment includes a stem and a plurality of members being oriented at right angles with each other such that said plurality of members defines a rectangle, said plurality of members including a lower member and an upper member, said stem being oriented perpendicular to said lower member, said stem being centrally positioned on said lower member, a distal end of said stem being coupled to said distal end of said handle portion of said paddle having said rectangle defined by said members being spaced from said handle portion, said roller being rotatably positioned around said upper member.

8. A watercraft paddle assembly having a rollable grip for enhancing comfort to a user, said assembly comprising:

a paddle having a handle portion being elongated and a paddle portion being flattened wherein said paddle portion is configured to be lowered into water for paddling a watercraft, said handle portion having a distal end with respect to said paddle portion, said handle portion having an outer surface being continuously arcuate about an axis extending between said distal end and said paddle portion such that said handle portion having a tubular shape wherein said handle portion is configured to facilitate the user to grip said handle portion, said paddle portion having an outer edge, said outer edge having a first lateral side, a second lateral side and a bottom side extending between said first lateral side and said second lateral side, each of said first lateral side and said second lateral side flaring outwardly between said handle portion and said bottom side such that said paddle portion has a tear drop shape;

a roller attachment being coupled to said handle portion, said roller attachment being distally positioned with respect to paddle portion of said paddle, said roller attachment having an attached section being oriented at an angle with a roller section, said roller section being spaced from said attached section, said attached section being attached to said handle portion having said roller section being spaced from said handle portion of said paddle, said roller attachment having a first end and a second end, said first end being associated with said attached section, said second end being associated with said roller section, said first end being coupled to said distal end of said handle portion of said paddle having said attached section being oriented to extend along said axis extending between said distal end of said handle portion and said paddle portion, said roller attachment having a series of bends each being positioned between said first end and said second end, said series of bends defining a first section being oriented perpendicular to said attached section having said first section extending laterally away from said attached section, said series of bends defining a second section being oriented perpendicular to said first section having said second section extending along an axis being oriented parallel to said axis extending through said distal end of said handle portion and said paddle portion of said paddle, said bends defining said roller section being oriented perpendicular to said second section having said roller section extending along an axis being oriented perpendicular to said axis extending through said distal end of said handle portion and said paddle portion of said paddle, said roller section being spaced from said first section to define a hand space between said roller section and said first section wherein said hand space is configured to accommodate the user's hand;

a roller being rotatably integrated into said roller section of said roller attachment wherein said roller is configured to be gripped by the user, said roller being oriented to rotate about an axis being oriented perpendicular to a lengthwise axis of said paddle wherein said roller is configured to facilitate the user to grip said roller and said handle portion of said paddle in a preferred manner for paddling, said roller having a primary end, a secondary end and an outside surface extending between said primary end and said secondary end, said roller section extending through said primary end toward said secondary end such that said roller rotates about said roller section wherein said roller is configured to facilitate the user's forearm associated with the hand that is gripping said roller to be oriented at a variety of angles with respect to said handle portion while the user is paddling; and wherein said roller attachment is comprises a socket for slidably receiving said distal end of said handle portion of said paddle such that said roller attachment is removably attachable to said handle portion, said socket having an outer wall, said outer wall having a plurality of apertures each extending through said outer wall, said apertures being spaced apart from each other and being distributed around a full circumference of said outer wall.

9. The assembly according to claim 8, further comprising a lock being movably integrated into said handle portion of said paddle, said lock being positioned adjacent to said distal end of said handle portion, said lock being biased to extend outwardly from said handle portion, said lock being urgeable inwardly on said handle portion, said lock engaging a respective one of said apertures in said outer wall of said socket thereby facilitating said roller to be oriented at a variety of angles with respect to said paddle portion of said paddle.

* * * * *